US005455481A

United States Patent [19]

Choi

[11] Patent Number: 5,455,481

[45] Date of Patent: Oct. 3, 1995

[54] ELECTRODE STRUCTURE OF AN ELECTRON GUN FOR A CATHODE RAY TUBE

[75] Inventor: Jin Y. Choi, Kyungsangbuk-Do, Rep. of Korea

[73] Assignee: Goldstar Co., Ltd., Seoul, Rep. of Korea

[21] Appl. No.: 96,492

[22] Filed: Jul. 22, 1993

[30] Foreign Application Priority Data

Jul. 25, 1992 [KR] Rep. of Korea ..... 92-13364

[51] Int. Cl.[6] ..... H01J 29/62

[52] U.S. Cl. ..... 313/414; 313/412; 313/449; 313/460; 315/368.15

[58] Field of Search ..... 313/414, 412, 313/425, 428, 432, 439, 449, 460; 315/368.15, 382

[56] References Cited

U.S. PATENT DOCUMENTS

| | | | |
|---|---|---|---|
| 4,697,120 | 9/1987 | Alig et al. | 313/412 |
| 4,772,826 | 9/1988 | Bloom et al. | 313/412 X |
| 4,772,827 | 9/1988 | Kuniharu | 313/412 X |

*Primary Examiner*—Sandra L. O'Shea
*Assistant Examiner*—Ashok Patel
*Attorney, Agent, or Firm*—Helfgott & Karas

[57] ABSTRACT

An electrode structure of an electron gun for a cathode ray tube has a plurality of cathodes for emitting thermions, grid electrodes to form an electron beam of thermions, a first acceleration and focus electrode, a second acceleration and focus electrode and a dipole lens system which forms a circular beam spot on a screen of the cathode ray tube by removing the horizontal lengthening of the beam spot due to an increase in the amount of deflection of the beam in the peripheral portion of the screen of the cathode ray tube. The dipole lens system has a first electrode and a second electrode to which a dynamic voltage of a predetermined range is applied. The first electrode of the dipole lens system has opening portions which pierce the upper and lower sides of the first accelerator and focus electrode. The second electrode of the dipole lens system has horizontal plates which cover the opening portions with a predetermined gap. By applying a dynamic voltage to the second accelerator and focus electrode in the peripheral portion of the screen of the cathode ray tube, the focal distance of the main focus lens between an anode electrode and the second accelerator and focus electrode is increased, thereby removing the halo portion of the beam spot.

6 Claims, 3 Drawing Sheets

ELECTRODE STRUCTURE OF AN ELECTRON GUN FOR A CATHODE RAY TUBE

BACKGROUND OF THE INVENTION

1. Field of the Invention

The present invention relates to an electrode structure of an electron gun for a cathode ray tube, and more particularly to an electrode structure of an electron gun for a cathode ray tube which can improve the resolution of a cathode ray tube by providing a dipole lens, removing a halo portion and the horizontal lengthening of a beam spot due to increase the amount of deflection and the focal distance in the peripheral portion of a screen of the cathode ray tube.

2. Description of the Prior Art

An electron gun for a cathode ray tube is generally formed by fixing a plurality of grid electrodes having circular electron beam-passing apertures so as to be in-line at specific intervals by way of bead glasses.

Referring to FIG. 1, a conventional electrode structure of an electron gun for an in-line type color picture tube comprises three cathodes $K_1$, $K_2$ and $K_3$ respectively having each built-in heaters $H_1$, $H_2$ and $H_3$ for emitting thermions, a first grid electrode $G_1$ and a second grid electrode $G_2$ for controlling and accelerating thermions to form an electron beam, and a first accelerator and focus electrode $G_3$, a second accelerator and focus electrode $G_4$, and an anode $G_5$ constituting a main focus lens for forming a beam spot on the screen by further focussing the electron beam.

Also, a multistage focus type electron gun which strengthens a focus effect further comprises a third grid electrode and a fourth grid electrode for reserve focus between a grid electrode which forms an electron beam and an accelerator and focus electrode which constitutes a main focus lens.

In such a cathode ray tube, it is preferably that a beam spot is uniform over the screen in order to obtain high picture quality.

However, the electron beam from an electron gun is deflected to be projected over the screen according to the intensity of deflection magnetic field of deflection yoke provided near the outlet of the electron gun. Accordingly, a small circular beam spot can be formed in the central portion of the screen on which a deflection magnetic field has no effect, but the beam spot is lengthened in the horizontal direction in the peripheral portion of the screen shown in dotted line in FIG. 8.

A beam spot lengthened in the horizontal direction as above consists of a core portion whose electron density is high and a halo portion whose electron density is low. The above horizontal lengthening of a beam spot becomes significant in the peripheral portion of the screen because a self-convergence deflection magnetic field becomes more intensive and the distance from the screen becomes longer as the electron beam goes to the peripheral portion of the screen, thereby causing deterioration in the resolution of the screen.

In order to remove the above phenomenon, a dynamic voltage compensating for the above phenomenon is previously applied to one of the electrodes. In U.S. Pat. No. 4,772,827 to Kuniharu Osakabe, there is disclosed an electron gun comprising a rear focus electrode system which includes a first focus electrode, a second focus electrode comprising a first grid electrode and a second grid electrode, and a third grid electrode disposed between the first and second focus electrodes. And, the electron gun of Kuniharu Osakabe applies a constant focus voltage to the first focus electrode and the first grid electrode applies to the second grid electrode a dynamic voltage superimposed on the constant voltage and applies a high voltage to the third grid electrode system.

However, according to the invention of Kuniharu Osakabe, two grid electrodes are added and a quadruple lens is formed between the two grid electrodes by way of plate shaped projections attached to the surface of the grid electrodes. Therefore, the electrode structure becomes complex and the manufacturing cost increases.

SUMMARY OF THE INVENTION

The present invention has been made to overcome the problems involved in the prior art.

It is an object of the present invention to provide an electrode structure of an electron gun for a cathode ray tube which can form a uniform beam spot over the screen by removing problems due to deflection and focal distance of an electron beam.

It is another object of the present invention to provide an electrode structure of an electron gun which provides a compact dipole lens between a first accelerator and focus electrode and a second accelerator and focus electrode.

In order to achieve the above objects, there is provided an electrode structure of an electron gun for a cathode ray tube comprising:

a cathode electrode for emitting thermions;

a first grid electrode and a second grid electrode for forming an electron beam by controlling and accelerating the thermions;

a first accelerator and focus electrode provided at the rear terminal of the first and second grid electrodes, for accelerating and focussing the electron beam;

a second accelerator and focus electrode constituting a main focus lens with the first accelerator and focus electrode, for forming a beam spot on the screen by further focussing the electron beam; and a dipole lens means comprising a first electrode and a second electrode, for lengthening the electron beam which passes through the first accelerator and focus electrode in the vertical direction by diverging the beam in the vertical direction and focusing the beam in the horizontal direction.

At this time, the first electrode of the dipole lens means comprises opening portions respectively piercing upper and lower sides of the first accelerator and focus electrode. The second electrode of the dipole lens means comprises horizontal plates which sufficiently cover the opening portions with a predetermined gap by extending the second accelerator and focus electrode. A constant DC (direct current) voltage is applied to the first electrode of the dipole lens means and the first accelerator and focus electrode. To the second electrode of the dipole lens means and the second accelerator and focus electrode, a dynamic focus voltage obtained by superimposing a parabolic dynamic voltage on the constant voltage, in accordance with the amount of deflection, is applied.

Moreover, it is preferable that each of the opening portions has a rectangular form whose width perpendicular to the axial direction is 0.7 to 0.8 times that of the respective upper and lower side of the first accelerator and focus electrode and whose length in the direction horizontal to the axial direction is shorter than the width perpendicular to the axial direction.

Moreover, the second electrode of the dipole lens means may include electrode pieces which jut out from the horizontal plates of the second accelerator and focus electrode to the opening portions with a prescribed gap.

BRIEF DESCRIPTION OF THE DRAWINGS

The above objects and other advantages of the present invention will become more apparent by describing the preferred embodiments thereof with reference to the accompanying drawings, in which.

DETAILED DESCRIPTION OF THE PREFERRED EMBODIMENTS

Figure 1:
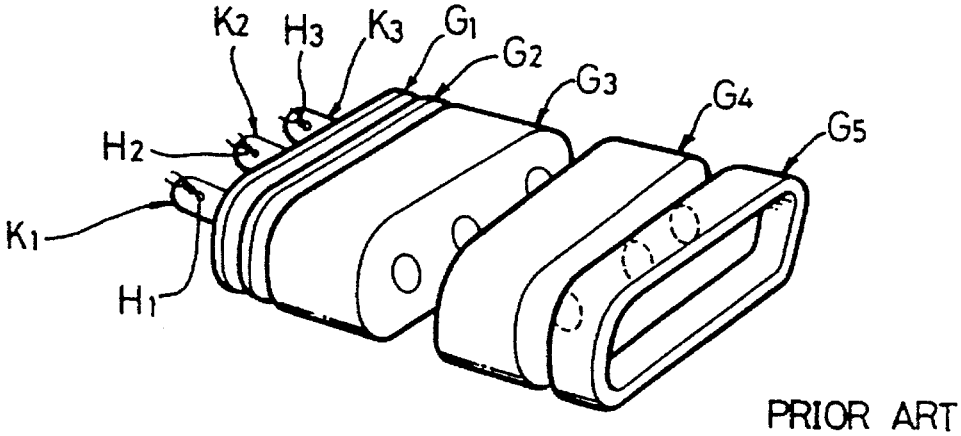
FIG. 1 is a perspective view of the conventional electrode structure of an electron gun for a color cathode ray tube.
Figure 2:
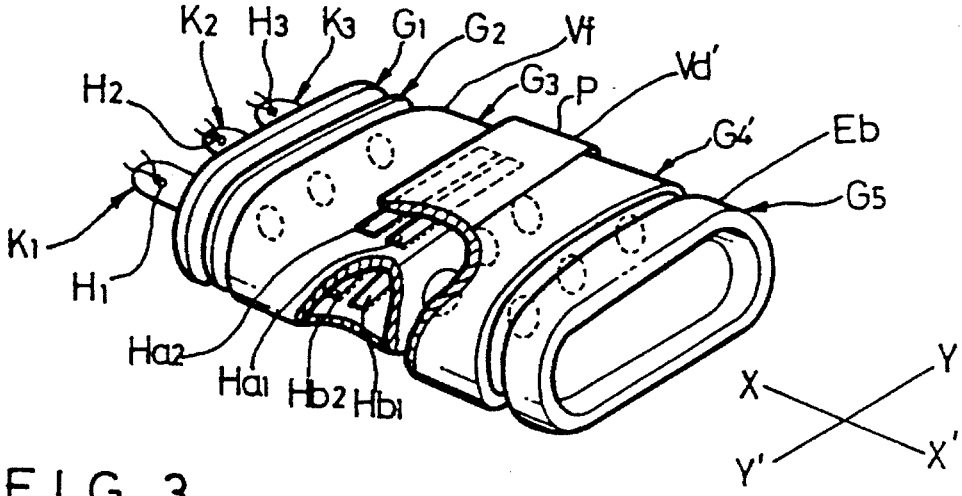
FIG. 2 is a perspective view of one embodiment of the electrode structure of an electron gun for a color cathode ray tube according to the present invention.

The electrode structure of an electron gun for a color cathode ray tube according to one embodiment of the present invention is illustrated referring to FIG. 2. The electrode structure comprises three cathode electrodes $K_1$, $K_2$ and $K_3$, a first grid electrode $G_1$, a second grid electrode $G_2$, a first accelerator and focus electrode $G_3$, a second accelerator and focus electrode $G_4$, and an anode electrode $G_5$, which are arranged along a line in the axial direction X–X'. A multistage dipole electrode according to one embodiment of the present invention is united to a first accelerator and focus electrode $G_3'$ and second accelerator and focus electrode $G_4'$.

Three cathodes $K_1$, $K_2$ and $K_3$ are arranged in a straight line perpendicular to the axial direction X–X', each of cathodes $K_1$, $K_2$ and $K_3$ containing therein a respective heater $H_1$, $H_2$ and $H_3$ for emitting thermions by heating the cathodes $K_1$, $K_2$ and $K_3$. First and second grid electrodes $G_1$ and $G_2$ form an electron beam by controlling and accelerating the thermions. First and second accelerating and focus electrodes $G_3'$ and $G_4'$ and anode electrode $G_5$ focus and accelerate the electron beam further and then project the beam on a fluorescent screen.

Figure 5A:
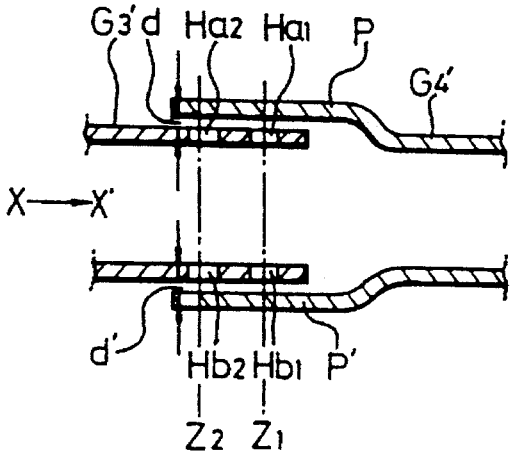
FIG. 5A is a sectional view taken along the line X—X' in the axial direction of the multistage dipole lens according to one embodiment of the present invention and FIG. 5B is a sectional view of another embodiment of the multistage dipole lens of the present invention.

Referring to FIGS. 2 and 5A, the multistage dipole electrode according to one embodiment of the present invention comprises a first electrode and a second electrode.

The first electrode of the multistage dipole electrode comprises opening portions $Ha_1$, $Ha_2$, $Hb_1$ and $Hb_2$ which pierce the upper and lower sides of the first accelerator and focus electrode $G_3'$, whereby opening portions $Ha_1$ and $Ha_2$ are vertically symmetrical to opening portions $Hb_1$ and $Hb_2$. It is preferable that each of the opening portions has a rectangular form whose width lo is 0.7 to 0.8 times the width ho of the respective upper and lower side of first accelerator and focus electrode $G_3'$ and whose length so is shorter than the width lo thereof.

The second electrode of the multistage dipole electrode comprises horizontal plates P and P', which sufficiently cover the opening portions $Ha_1$, $Ha_2$, $Hb_1$ and $Hb_2$ by extending the front upper and lower sides of second accelerator and focus electrode $G_4'$, each of horizontal plates P and P' respectively having a prescribed gap d and d' with upper and lower surfaces of first accelerator and focus electrode $G_3'$. It is preferable that gaps d and d' be equal to each other.

Figure 3:
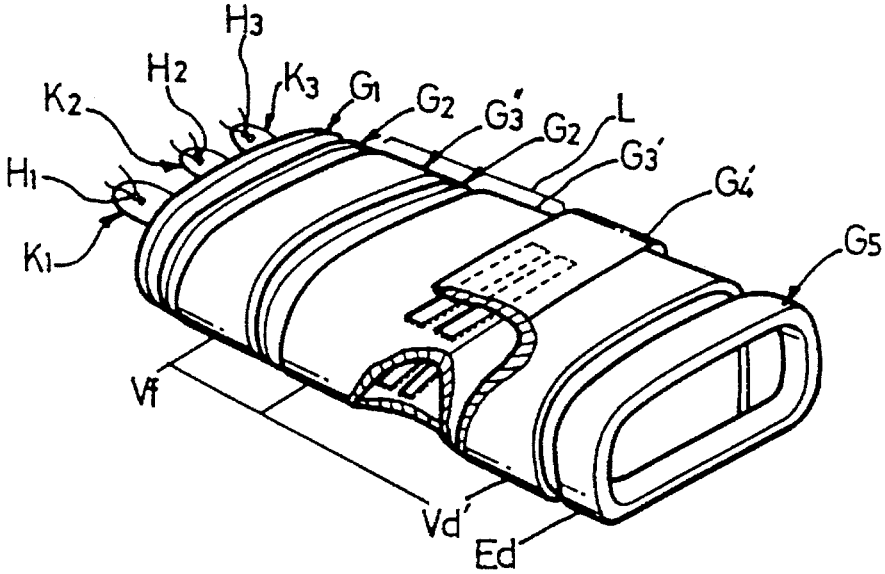
FIG. 3 is a perspective view of the electrode structure according to one embodiment of the present invention, where the structure applied to an electron gun is different from that of FIG. 2.
Figure 4:
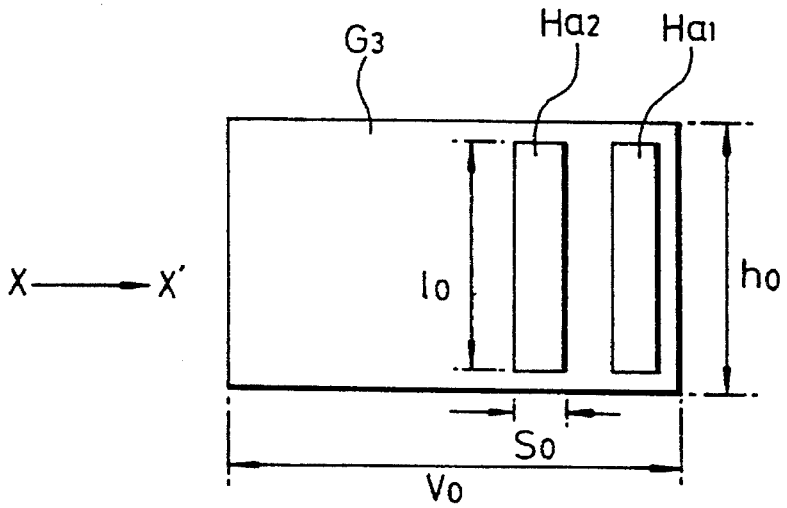
FIG. 4 is a schematic sectional view of an opening portion which is the first electrode of the multistage dipole lens according to one embodiment of the present invention.

FIG. 3 shows an electron gun which has a different structure from that of FIG. 2 according to one embodiment of the present invention. In such an electron gun, two auxiliary electrodes $G_2'$ and $G_3''$ are inserted between second grid electrode G2 and first accelerator and focus electrode $G_3'$. The two auxiliary electrodes $G_2'$ and $G_3''$ and first accelerator and focus electrode $G_3'$ form a front focus lens electrode system L between second grid electrode $G_2$ and second accelerator and focus electrode $G_4'$.

Figure 5B:
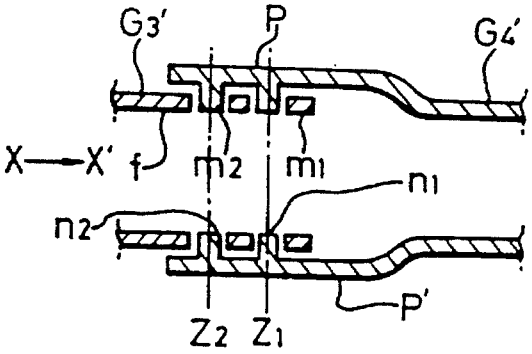

The construction of the dipole lens may change. For example, as shown in FIG. 5B, electrode pieces $m_1$, $m_2$, $n_1$ and $n_2$ may be attached to horizontal plates P and P' formed by extending second accelerator and focus electrode $G_4'$, electrode pieces $m_1$, $m_2$, $n_1$ and $n_2$ being inserted in opening portions $Ha_1$, $Ha_2$, $Hb_1$ and $Hb_2$ with a prescribed gap. In this case, the multistage dipole lens operates further actively.

Figure 6:
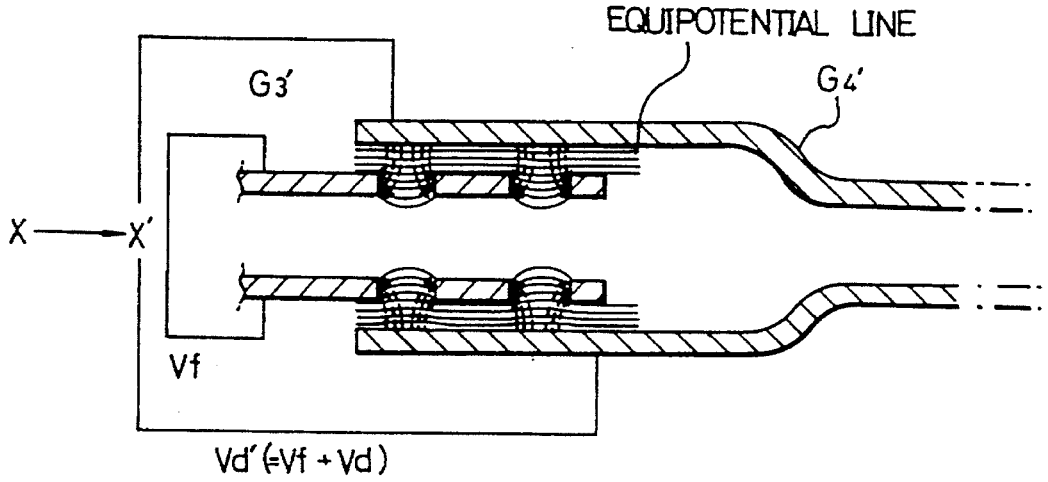
FIG. 6 is a sectional view of the multistage dipole lens for explaining the operation according to one embodiment of the present invention.

Referring to FIG. 6, to the first electrode of the dipole lens in FIG. 5B and first accelerator and focus electrode $G_3$, a constant DC focus voltage Vf is applied. And, to the second electrode of the dipole lens in FIG. 5B and second accelerator and focus electrode $G_4$, a dynamic focus voltage Vd'=Vd+Vf is applied, the dynamic focus voltage Vd' being obtained by superimposing a parabolic AC (alternating current) voltage Vd on a DC focus voltage Vf according to the difference between the amount of deflection and the focal distance of electron beam.

The operation and effect of the present invention constructed as above will be described as follows.

If an electron beam is projected on the central portion of the screen, the amount of deflection by deflection yoke is "0" and thus a parabolic AC voltage Vd becomes "0" and then is applied to the second electrode of multistage dipole electrode, that is, horizontal plates P and P'. Accordingly, the voltage of opening portions $Ha_1$, $Ha_2$, $Hb_1$ and $Hb_2$ is equal to that of horizontal plates P and P' as a DC focus voltage Vf so that the multistage dipole electrode has no effect on the electron beam therethrough. Thus, a beam spot has the original circular form in the central portion of the screen.

However, if the amount of deflection increases in the peripheral portion of the screen, dynamic focus voltage Vd' being applied to the second electrode increases. And, a potential difference Vd between dynamic focus voltage Vd' and DC focus voltage Vf is generated between the first electrode and the second electrode and thus two dipole lenses as shown in FIG. 6 are produced with respect to each of electron beams which passes between the upper and lower sides of the dipole electrode.

Figure 7:
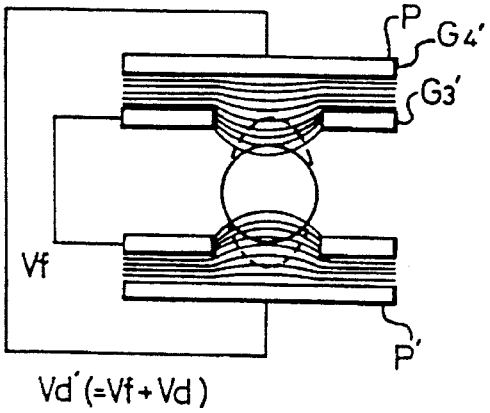
FIG. 7 is a modified shape diagram of an electron beam by the dipole lens according to one embodiment of the present invention.

Accordingly, each of the electron beams passing through in the axial direction X—X' is diverged twice in the vertical direction and thus the sectional shape of electron beam is changed into the elliptical form shown by the dotted line in FIG. 7 from the circular form shown by the solid line in FIG. 7. Thus, the electron beam is lengthened in the vertical direction.

In order to remove the horizontal lengthening of an electron beam due to the difference between the amount of deflection and the focal distance, the electron beam is previously lengthened in the vertical direction in an amount corresponding to the horizontal lengthening. Accordingly, the vertically lengthened electron beam passes through anode electrode $G_5$ and is deflected by the deflection yoke to be lengthened in the horizontal direction and thus forms a circular beam spot like at the central portion of the screen.

Moreover, because the focal distance of the main focus lens between the second accelerator and focus electrode $G_4'$ and the anode electrode $G_5$ increases as the dynamic focus voltage Vd' applied to second accelerator and focus electrode $G_4'$ increases, the electron beam focused by the main focus lens can always be uniformly projected on the screen even though the amount of deflection increases.

Figure 8:
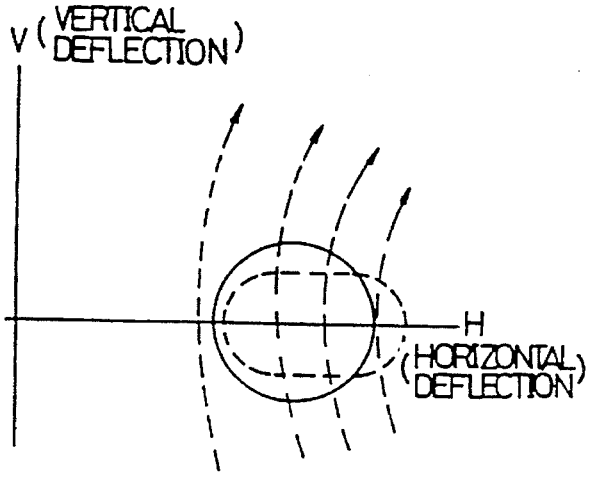
FIG. 8 is a modified shape diagram of the electron beam by a Pincushion magnetic field which is a horizontal deflection magnetic field.

As described above, an electron beam lengthened in the horizontal direction due to an increase in the amount of deflection as shown in FIG. 8 can be previously compensated by a multistage dipole lens according to the present invention and thus a circular beam spot can be formed even on the peripheral portion of a screen. Also, the distance between each point of the peripheral portion of the screen and a start point of deflection is made to be in accord with each of the focal distances of the main focus lens lengthened by dynamic focus voltage Vd' in accordance with the amount of deflection of the second accelerator and focus electrode $G_4'$ so that the halo portion whose electron density is low around the core portion can be significantly removed.

From the foregoing, according to the invention, the action of the multistage dipole lens in accordance with the amount of deflection and control of the thickness of the main focus lens are simultaneously performed so that a circular beam spot composed of a core portion whose electron density is high can be formed on the screen. Therefore, high definition of a cathode ray tube can be achieved.

While the present invention has been described and illustrated herein with reference to the preferred embodiments of an in-line type color picture tube, it will be understood by those skilled in the art that various changes in form and number of dipole lenses and details may be made therein without departing from the spirit and scope of the invention.

What is claimed is:

1. An electrode structure of an electron gun for a cathode ray tube, comprising:

a plurality of cathode electrodes for emitting thermions;

first and second grid electrodes positioned at the rear of the cathode electrodes for controlling and accelerating said thermions to form an electron beam;

a first accelerator and focus electrode, provided at the rear of said first and second grid electrodes, for accelerating and focussing said electron beam;

a second accelerator and focus electrode constituting a main focus lens with said first accelerator and focus electrode, for forming a beam spot on a screen of said cathode ray tube by further focussing said electron beam;

said first and second grid electrodes and said first and second accelerator and focus electrodes being positioned in line in a direction of an axis of elongation of the electrode structure wherein said beam spot on said screen may be lengthened in a horizontal direction; and a dipole lens means including a first electrode provided on upper and lower sides of said first accelerator and focus electrode and a second electrode provided on said second accelerator and focus electrode, for lengthening said electron beam which passes through said first accelerator and focus electrode in a direction vertical in respect to said horizontal direction by diverging said electron beam in the vertical direction and focussing said electron beam in said horizontal direction;

said first electrode of said dipole lens means being formed by opening portions piercing each of said upper and lower sides of said first accelerator and focus electrode, and said second electrode of said dipole lens means including cover plates extending along upper and lower sides of said second accelerator and focus electrode so as to cover said opening portions with a predetermined gap;

wherein a constant voltage is applied to said first accelerator and focus electrode, and a dynamic voltage is applied to said second accelerator and focus electrode.

2. An electrode structure of an electron gun for a cathode ray tube as claimed in claim 1, wherein said dipole lens means forms a multistage dipole lens means and includes further opening portions which also pierce the upper and lower sides of said first accelerator and focus electrode next to said opening portions.

3. An electrode structure of an electron gun for a cathode ray tube as claimed in claim 1, wherein each of said opening portions has a rectangular form whose width perpendicular to an axial direction of the electrode structure is 0.7 to 0.8 times the width of a respective upper and lower side of said first accelerator and focus electrode and whose length extending in said axial direction is shorter than said width perpendicular to said axial direction.

4. An electrode structure of an electron gun for a cathode ray tube as claimed in claim 1, wherrein said second electrode of said dipole lens means includes electrode pieces extending from said cover plates of said second electrode to said opening portions with a predetermined gap.

5. An electrode structure of an electron gun for a cathode ray tube as claimed in claim 1, wherein said dynamic voltage has a parabolic form in accordance with an amount of deflection of said electron beam.

6. An electrode structure of an electron gun for a cathode ray tube comprising:

a plurality of cathode electrodes for emitting thermions;

first and second grid electrodes positioned at the rear of the cathode electrodes, for controlling and accelerating said thermions to form an electron beam;

a first accelerator and focus electrode, provided at the rear of said first and second grid electrodes, for accelerating and focussing said electron beam;

a second accelerator and focus electrode constituting a main focus lens with said first accelerator and focus electrode, for forming a beam spot on a screen of said cathode ray tube by further focussing said electron beam;

said first and second grid electrodes and said first and second accelerator and focus electrodes being positioned in line in a direction of an axis of said electrode structure wherein said beam spot may be lengthened in a horizontal direction;

a dipole lens means including a first electrode provided on upper and lower sides of said first accelerator and focus electrode and a second electrode provided on said second accelerator and focus electrode, for lengthening said electron beam which passes through said first accelerator and focus electrode in a direction vertical in respect to said horizontal direction by diverging said electron beam in the vertical direction and focussing said electron beam in said horizontal direction; and at least one auxiliary electrode provided between said second grid electrode and said first accelerator and focus electrode, for forming a front focus lens with said second grid and said main focus lens;

said first electrode of said dipole lens means being formed by opening portions piercing each of said upper and lower sides of said first accelerator and focus electrode, and said second electrode of said dipole lens means including cover plates extending along upper and lower sides of said second accelerator and focus electrode so as to cover said opening portions with a predetermined gap; and wherein a constant voltage is applied to said first accelerator and focus electrode, and a dynamic voltage is applied to said second accelerator and focus electrode.

* * * * *